US009174456B1

(12) United States Patent
Inoue

(10) Patent No.: US 9,174,456 B1
(45) Date of Patent: Nov. 3, 2015

(54) PRINTING DEVICE, NOTIFICATION METHOD, AND INK RIBBON CASSETTE

(71) Applicant: TOSHIBA TEC KABUSHIKI KAISHA, Shinagawa, Tokyo (JP)

(72) Inventor: Yoshimasa Inoue, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/309,770

(22) Filed: Jun. 19, 2014

(51) Int. Cl.

| | |
|---|---|
| ***B41J 31/00*** | (2006.01) |
| ***B41J 2/325*** | (2006.01) |
| ***B41J 29/38*** | (2006.01) |

(52) U.S. Cl.
CPC . *B41J 2/325* (2013.01); *B41J 29/38* (2013.01)

(58) Field of Classification Search
USPC ..... 347/213, 214, 171–178; 400/120.01–120.04, 237, 240.1–240.4
See application file for complete search history.

(56) References Cited

U.S. PATENT DOCUMENTS

| | | | | |
|---|---|---|---|---|
| 6,646,666 | B2 * | 11/2003 | Matsuoka | 347/213 |
| 7,079,167 | B2 * | 7/2006 | Hayashi | 347/214 |
| 8,382,389 | B2 * | 2/2013 | Yamaguchi et al. | 347/214 |

FOREIGN PATENT DOCUMENTS

| | | |
|---|---|---|
| JP | 2000-225740 | 8/2000 |
| JP | 2001-026159 | 1/2001 |
| JP | 2002-019203 | 1/2002 |

* cited by examiner

*Primary Examiner* — Kristal Feggins
(74) *Attorney, Agent, or Firm* — Patterson & Sheridan, LLP

(57) ABSTRACT

A printing device includes a printing mechanism that allows a loop-shaped ink ribbon to be detachably installed therewith, and applies an impact to the ink ribbon to transfer ink of the ink ribbon to a printing medium, a cumulative printed amount acquisition section that acquires a cumulative printed amount of the printing mechanism after the ink ribbon installed on the printing mechanism was last exchanged, a determination section that determines whether or not the cumulative printed amount acquired by the cumulative printed amount acquisition section has reached a predetermined first printing amount, or whether or not the cumulative printed amount has reached a second printing amount to be calculated based on the first printing amount, and an output control section that causes an output device to output a predetermined output if the determination section determines that the cumulative printed amount reaches the first or second printing amount.

20 Claims, 16 Drawing Sheets

FIG. 2

| | CHARACTER INFORMATION | FONT INFORMATION |
|---|---|---|
| PRINTING INFORMATION 1 | "AB" | Draft Font |
| PRINTING INFORMATION 2 | "AB" | LQ Font |

FIG. 15

240

| | TIME INFORMATION | PRINTING AMOUNT |
|---|---|---|
| RECORD 1 | 13:11, JANUARY 1, 2014 | 310 |
| RECORD 2 | 14:22, JANUARY 1, 2014 | 650 |
| RECORD 3 | 15:33, JANUARY 1, 2014 | 240 |

⋮

PRINTING DEVICE, NOTIFICATION METHOD, AND INK RIBBON CASSETTE

FIELD

Embodiments described herein relate generally to a printing device, a notification method, and an ink ribbon cassette.

BACKGROUND

A dot impact printer is known in which an impact is applied to an ink ribbon with a dot point, i.e., a small mechanical impacting element, and ink from the ink ribbon is transferred to a printing medium. Generally, an ink ribbon used in the dot impact printer is a continuous loop. For this reason, a user may continuously use the ink ribbon without exchanging the ink ribbon even when the ink ribbon has made a complete loop in use.

If an ink ribbon continues to be used after it has travelled over an entire loop, the printing quality of the dot impact printer using that ink ribbon deteriorates. A user is thus required to exchange the ink ribbon at an appropriate timing, before a full loop of the ink ribbon has traveled past the printing point, in order to maintain printing quality in a predetermined or higher level.

DESCRIPTION OF THE DRAWINGS

FIG. 2 is a diagram illustrating elements of printing information.

FIG. 15 is a diagram illustrating a state in which a printing amount is stored in a storage section in correlation with time information.

DETAILED DESCRIPTION

Figure 1:
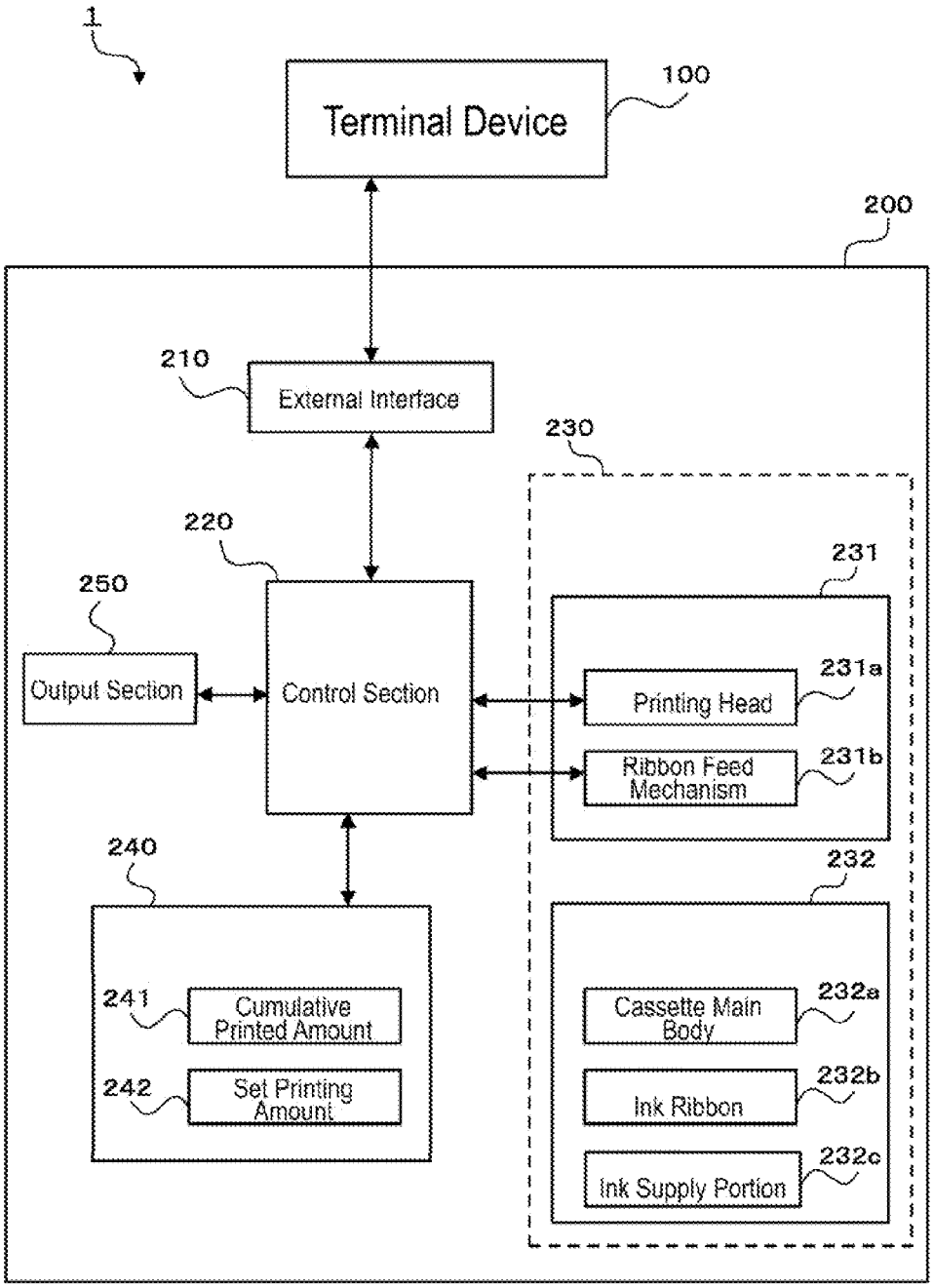
FIG. 1 is a block diagram of a printing system according to a first embodiment.

Embodiments provide a printing device, a notification method, and an ink ribbon cassette capable of informing a user of an appropriate exchange timing of the ink ribbon.

In general, according to one embodiment, a printing device includes a printing mechanism that allows a loop-shaped ink ribbon to be detachably installed, and applies an impact to the ink ribbon to transfer ink of the ink ribbon to a printing medium; a cumulative printed amount acquisition section that acquires a cumulative printed amount of the printing mechanism after the ink ribbon installed on the printing mechanism was last exchanged; a determination section that determines whether or not the cumulative printed amount acquired by the cumulative printed amount acquisition section reaches a predetermined first printing amount, or whether or not the cumulative printed amount reaches a second printing amount to be calculated based on the first printing amount; and an output control section that causes an output section to output a predetermined output if the determination section determines that the cumulative printed amount reaches the first printing amount or the second printing amount.

Hereinafter, embodiments will be described with reference to the drawings. In addition, in the drawings, the same or equivalent parts are given the same reference numerals.

In general, a printing system 1 is provided wherein ink carried on a ribbon is transferred therefrom to a printing medium, and the cumulative quantity of ink transferred from the ribbon is estimated based on the number of "standard" images printed therewith, so that the user of the ink ribbon may receive an indication or warning that the image quality of the print accomplished with the ink ribbon will soon deteriorate. For example, where the printing is of characters such as letters and numbers, a standard font character is given an ink usage value, which may arbitrarily set to one. The ink ribbon, when new, is estimated to be capable of printing X number of standard font characters. Other font sizes and resolutions will are designated as using ink at a multiple of a standard font character, for example twice as much or more ink depending on size and resolution, and thus an equivalent standard font character using a multiple of the ink in a standard font character can be calculated. The system 1 tallies the number of standard font characters printed, counting for example a one for a standard font character, and counting two standard font characters when a character twice as high, but the same widths as, a standard font character, is printed. The tally is compared to a known or an estimated number of standard font characters that can be printed with the ink ribbon, and the user is notified, such as by a blinking light, that the ink ribbon has reached the end of its useful life when the tally reaches the total number of standard font characters that can be printed therewith.

The system can be configured to provide the warning prior to the actual end of the ink ribbon life, based on reaching a selected percentage of the total number of standard font characters or their equivalents being printed, or based on predicted usage of the ink ribbon based on past usage thereof.

(First Embodiment)

A printing system 1 including a printing device of the embodiment is a system which prints printing information input from a user. The printing system 1 includes a terminal device 100 and a printing device 200 as illustrated in FIG. 1.

The terminal device 100 includes an input and output terminal such as a personal computer. The terminal device 100 is connected to the printing device 200 via a universal serial bus (USB) cable or a wireless local area network (LAN). The terminal device 100 transmits printing information which is input from a user, to the printing device 200.

The printing device 200 is a dot impact printer which prints the printing information transmitted from the terminal device 100, on a printing medium such as a bankbook or a copying slip. The printing device 200 includes, as illustrated in FIG. 1, an external interface 210, a control section 220, a printing mechanism 230, a storage section 240, and an output section 250.

The external interface 210 includes an external device connection interface such as a local area network (LAN) interface or a universal serial bus (USB) interface. The external interface 210 transmits printing information which is received from an external device such as the terminal device 100, to the control section 220.

Figure 3A:
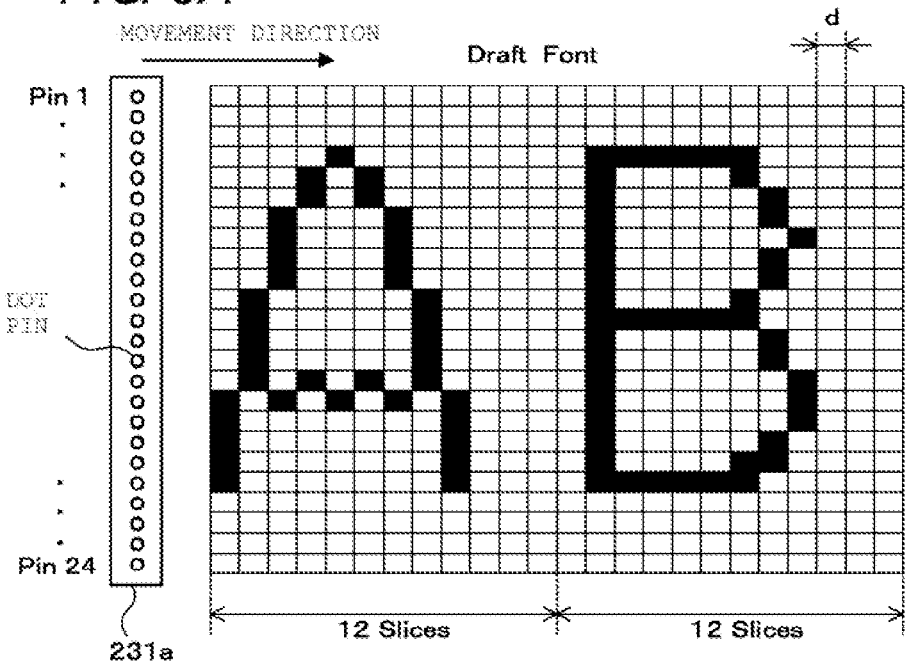
FIGS. 3A and 3B are diagrams illustrating characters of different fonts.
Figure 3B:
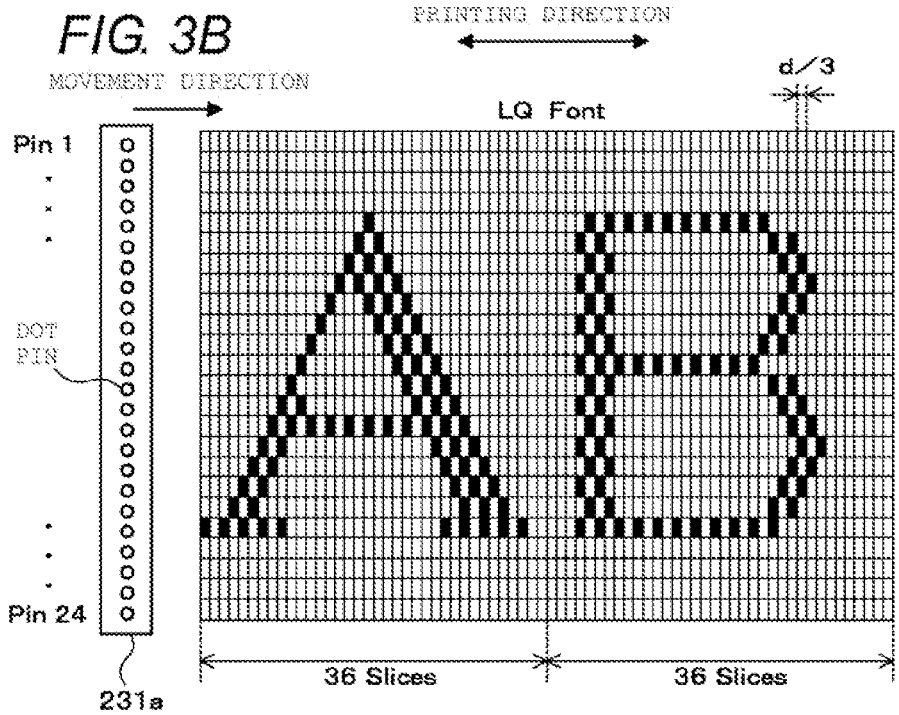

In addition, in the following description, for better understanding, the "printing information" received by the external interface 210 from the terminal device 100 is assumed to be information formed by character information and font information as illustrated in FIG. 2. The "character information" is a character code indicating a character such as "AB", and the "font information" is information for designating a resolution of a character, a size of a character, a style of the character, or the like. In the present embodiment, it is assumed that "resolution information" for designating a resolution of a character is set in the font information. More specifically, for example, as illustrated in FIGS. 3A and 3B, either "Draft Font" indicating that a single character is formed by a resolution of 24×12 or "LQ (Letter Quality) Font" indicating that a single character is formed by a resolution of 24×36 is set in the font information.

Figure 4:
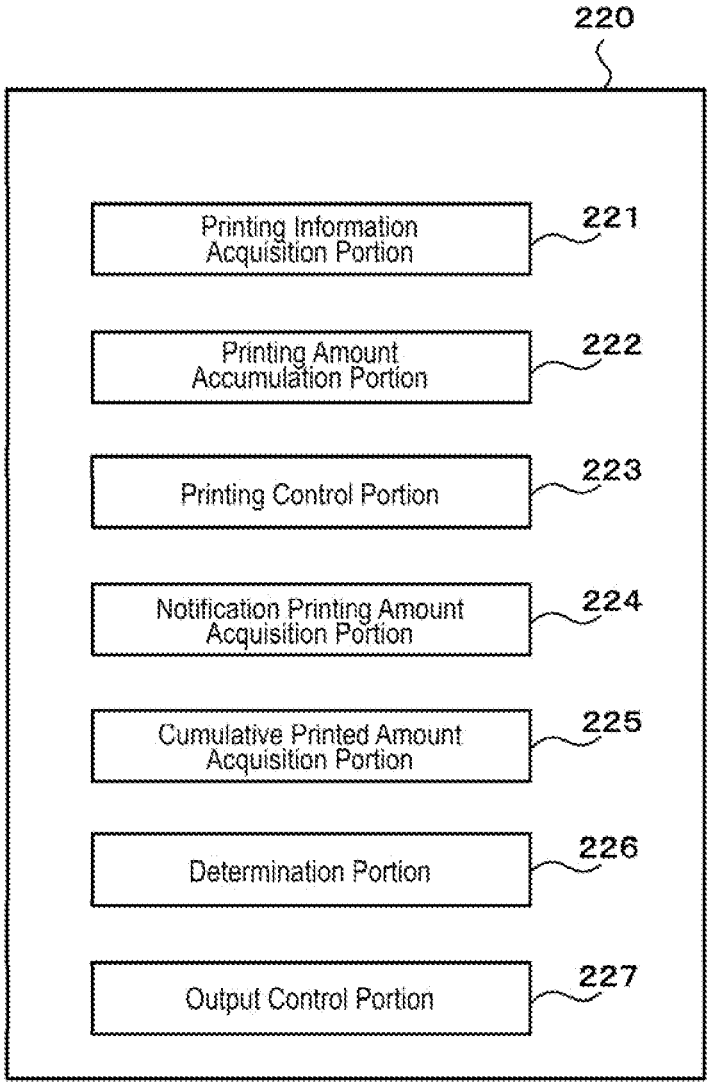
FIG. 4 is a functional block diagram of a control section included in a printing device.

Referring again to FIG. 1, the control section 220 includes a processing unit such as a processor. The control section 220 is operated according to a program stored in a read only memory (ROM) or a random access memory (RAM) (not illustrated), so as to perform various operations including a "printing process" described later. The control section 220 performs the printing process so as to function as, as illustrated in FIG. 4, a printing information acquisition portion 221, a printing amount accumulation portion 222, a printing control portion 223, a notification printing amount acquisition portion 224, a cumulative printed amount acquisition portion 225, a determination portion 226, and an output control portion 227. These functions will be described in a part of describing the "printing process" described later. In addition, the control section 220 may be constituted by a single processor, and may be constituted by a plurality of processors. If the control section 220 includes a plurality of processors, the control section 220 may perform the printing process through cooperation of the plurality of processors.

Figure 5:
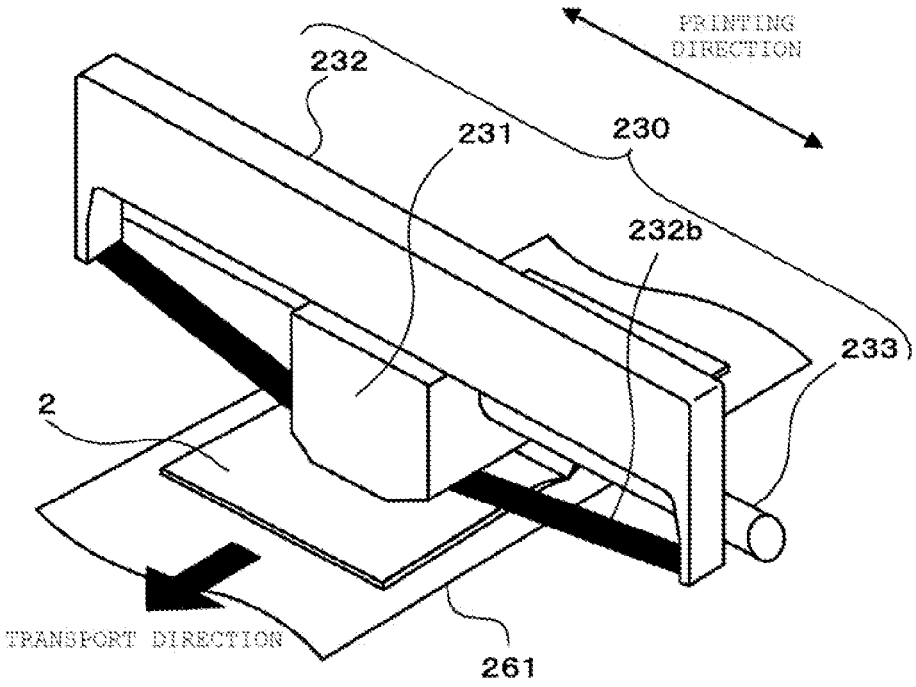
FIG. 5 is a perspective view of a printing mechanism included in the printing device.

Referring to FIG. 1 again, the printing mechanism 230 is a mechanism which prints printing information on a printing medium 2. More specifically, the printing mechanism 230 is a mechanism which applies a physical impact to an ink ribbon 232*b* with dot pins, so as to transfer ink of the ink ribbon 232*b* onto the printing medium 2. The printing device 200 includes a plate-shaped transport path 261, for example, as illustrated in FIG. 5. The printing device 200 operates a transport roller (not illustrated) so as to transport the printing medium 2 which is inserted from an insertion opening (not illustrated), to a position where the printing mechanism 230 is located. In addition, in the following description, for better understanding, a direction in which the printing medium 2 travels is referred to as a "transport direction".

As illustrated in FIG. 5, the printing mechanism 230 includes a carriage 231 and an ink ribbon cassette 232.

The carriage 231 is a unit for mounting a printing head 231*a* thereon. The carriage 231 is fixed to a shaft 233 in a reciprocating manner. The shaft 233 is fixed to the printing device 200 toward an axis in a direction (hereinafter, referred to as a "printing direction") perpendicular to the transport direction. The carriage 231 is moved, using the shaft 233 as a guide, under the control of the control section 220. The carriage 231 is mounted with the printing head 231*a* and a ribbon feed mechanism 231*b* as illustrated in FIG. 1.

The printing head 231*a* includes a dot printing head. The printing head 231*a* includes a plurality of dot pins (24 dot pints in the example of FIGS. 3A and 3B) which are disposed in a line in a direction perpendicular to the printing direction as illustrated in FIGS. 3A and 3B. The printing head 231*a* selectively applies an impact on the dot pins under the control of the control section 220 while the printing head 231*a* is moved in the printing direction (that is, the carriage 231 is moved in the printing direction), so as to transfer ink from the ribbon cassette 232 and thus print printing information on the printing medium 2. For example, if a character of Draft Font is printed, the control section 220 sequentially moves the printing head 231*a* by a distance of d, and applies an impact on the ink ribbon 232*b* with selected ones of the dot pins in 12 individual stepped movements of the printing medium with respect thereto so as to form a single character. In addition, if a character of LQ Font is printed, i.e., a higher resolution font, the control section 220 sequentially moves the printing head 231*a* by a distance of d/3, and applies an impact on the ink ribbon 232*b* with selected ones of the dot pins in 36 individual stepped movements of the printing medium with respect thereto so as to form a single character. Further, in the present embodiment, the number of slices of LQ Font is three times the number of slices of Draft Font. For this reason, a movement distance of the printing head per impact of LQ Font is ⅓ of a movement distance of the printing head 231*a* per impact of Draft Font.

The ribbon feed mechanism 231*b* includes a plurality of pairs of rollers which pinch the ink ribbon 232*b*. The ribbon feed mechanism 231*b* feeds the ink ribbon 232*b* in the printing direction at any time by rotating the rollers. In addition, a feed amount of the ink ribbon 232*b* per impact is the same regardless of a resolution of a character. For this reason, a feed amount of the ink ribbon 232*b* per character of LQ Font is three times the feed amount of the ink ribbon 232*b* per character of Draft Font.

Figure 6:
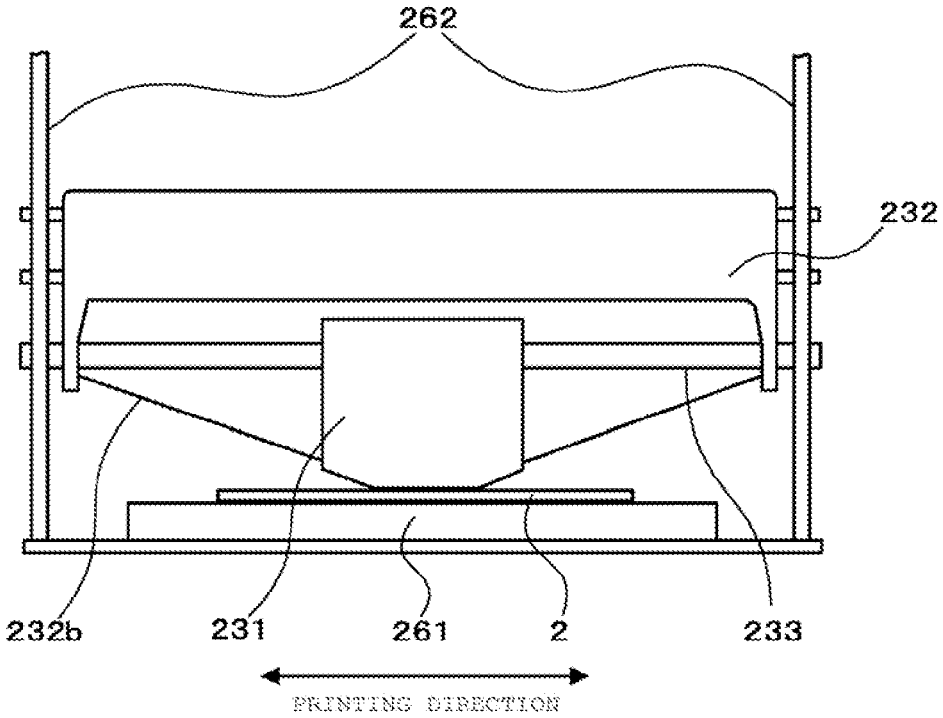
FIG. 6 is a front view of the printing mechanism included in the printing device.

The ink ribbon cassette 232 is a cassette which is attachable to, and detachable from, the printing device 200. The printing device 200 includes a pair of side plates 262 therein, for example, as illustrated in FIG. 6. The ink ribbon cassette 232 is fixed to the side plates 262. The side plates 262 are provided with sensors (not illustrated). The control section 220 detects attachment and detachment of the ink ribbon cassette 232 based on a value from the sensors.

Figure 7:
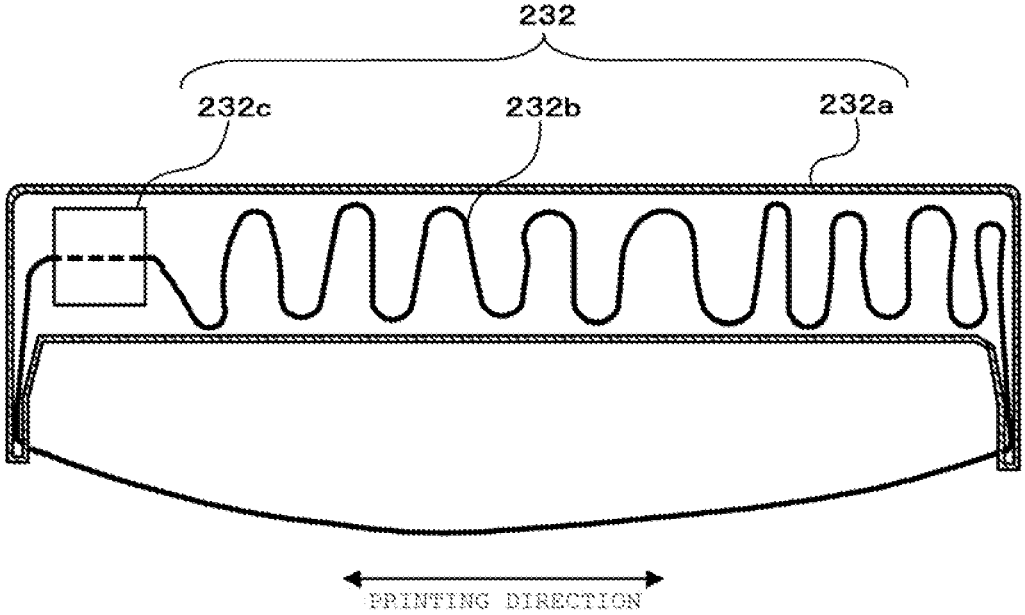
FIG. 7 is a diagram illustrating an internal configuration of an ink ribbon cassette installed in the printing mechanism.

The ink ribbon cassette 232 includes, as illustrated in FIG. 7, a cassette main body 232*a*, the ink ribbon 232*b*, and an ink supply portion 232*c*.

The cassette main body 232*a* is a casing detachably provided on the printing device 200. The ink ribbon 232*b* and the ink supply portion 232*c* are stored in the casing.

The ink ribbon 232*b* is a strip-shaped member onto which ink is adsorbed, the ink being capable of being transferred therefrom to the printing medium 2. The ink ribbon 232*b* is formed in a loop shape, for example, a Mobius strip shape so as to allow both sides to be used, and a part thereof is exposed to the outside of the cassette main body 232*a*. The ink ribbon 232*b* is set so that the exposed part passes through the inside of the carriage 231, for example, as illustrated in FIG. 6. The ribbon feed mechanism 231*b* is disposed inside the carriage 231 as described above. The ink ribbon 232*b* is fed in the printing direction by the ribbon feed mechanism 231*b*.

Referring to FIG. 7 again, the ink supply portion 232*c* is an ink tank which supplies ink to the ink ribbon 232*b*. The ink ribbon 232*b* is disposed so as to pass through the inside of the ink supply portion 232*c*. The ink supply portion 232*c* replenishes the ink ribbon 232*b* with ink when the ink ribbon 232*b* passes therethrough.

Referring to FIG. 1 again, the storage section 240 includes a data readable and writable nonvolatile memory such as a flash memory or a hard disk. As illustrated in FIG. 1, various information pieces such as a cumulative printed amount 241 and a set printing amount 242 are stored in the storage section 240.

The cumulative printed amount 241 is a cumulative printed amount of the printing mechanism 230 after the ink ribbon cassette 232 was last exchanged. The control section 220 counts up a value of the cumulative printed amount 241 by a predetermined amount whenever the printing mechanism 230 prints a single character. A counted-up amount is determined with a single character of Draft Font as a reference. For example, the control section 220 counts up a value of the cumulative printed amount 241 by 1 when a single character of Draft Font is printed. In addition, the control section 220 counts up a value of the cumulative printed amount 241 by 3 when a single character of LQ Font is printed. If exchange of the ink ribbon cassette 232 is detected, the control section 220 resets to zero the value of the cumulative printed amount 241.

The set printing amount 242 is an upper limit on the printing amount, which allows the ink ribbon cassette 232 to be continuously used while providing adequate printing quality. More specifically, the set printing amount 242 is an upper limit printing amount which allows the printing device 200 to print while maintaining printing quality which is set in advance by a device manufacturer or the like. The set printing amount 242 is set in advance by, for example, a manufacturer of the printing device 200, and is stored in the storage section 240.

The output section 250 includes output units such as a display, a speaker, and a light emitting diode (LED) lamp. The output section 250 outputs an image, a sound, and the like under the control of the control section 220.

Next, an operation of the printing system 1 with this configuration will be described.

The control section 220 of the printing device 200 starts a printing process if printing information is transmitted from the terminal device 100. Hereinafter, with reference to a flowchart of FIG. 8, a bankbook printing process will be described.

The printing information acquisition portion 221 of the control section 220 acquires printing information from the external interface 210 (step S101). For example, as illustrated in FIG. 2, the printing information includes "character information" such as "AB" and "font information" such as Draft Font or LQ Font.

Figure 8:
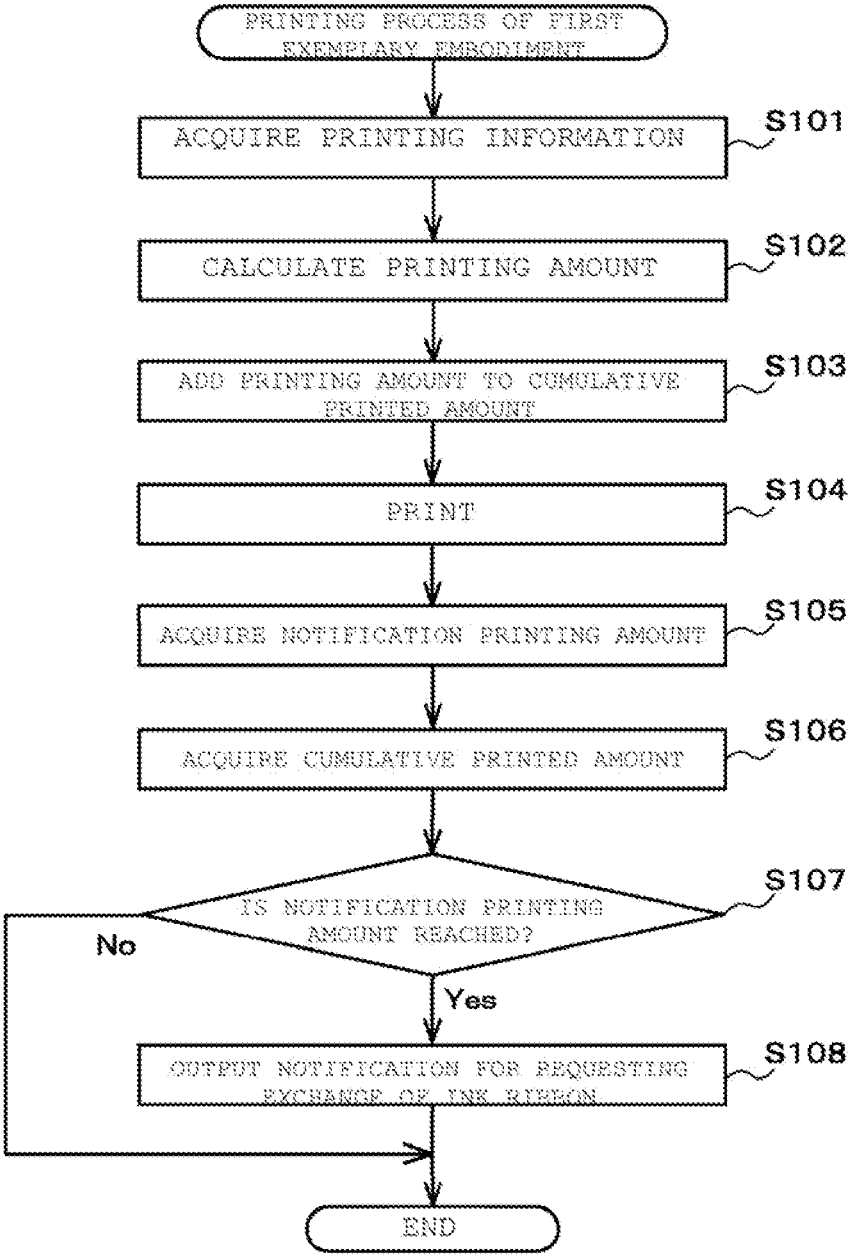
FIG. 8 is a flowchart illustrating a printing process according to the first embodiment.

Referring to the flow of FIG. 8, the printing amount accumulation portion 222 of the control section 220 calculates a printing amount of the printing information acquired in step S101 (step S102). At this time, the printing amount accumulation portion 222 calculates the printing amount of the printing information based on an amount of the ink ribbon 232*b* which is fed when the printing information is printed. More specifically, the printing amount accumulation portion 222 calculates the printing amount of the printing information by using an amount of the ink ribbon 232*b* which is fed when a single character of Draft Font is printed as one unit. For example, if character information included in the printing information indicates two characters such as "AB", and font information indicates Draft Font, the printing amount accumulation portion 222 calculates the printing amount as 2 (=2 characters×12 slices/12 slices). In addition, if character information included in the printing information indicates two characters such as "AB", and font information indicates LQ Font, the printing amount accumulation portion 222 calculates the printing amount as 6 (=2 characters×36 slices/12 slices).

Next, the printing amount accumulation portion 222 integrates the printing amount calculated in step S102 in the cumulative printed amount 241 of the storage section 240 (step S103).

Next, the printing control portion 223 of the control section 220 converts the printing information acquired in step S101 into image data which is then developed on an image buffer (not illustrated). In addition, the printing control portion 223 controls the printing mechanism 230 to print the image data developed on the image buffer on the printing medium 2 (step S104).

Next, the notification printing amount acquisition portion 224 of the control section 220 acquires the set printing amount 242 from the storage section 240. In addition, the notification printing amount acquisition portion 224 calculates a notification printing amount based on the set printing amount 242 (step S105). The notification printing amount is a printing amount which is used as a reference for the control section 220 performing a notification regarding the need to exchange the ink ribbon 232*b*. The notification printing amount acquisition portion 224 may acquire the set printing amount 242 as the notification printing amount without change, and may acquire a printing amount which is calculated based on the set printing amount 242, as the notification printing amount. Thus, the notification printing amount acquisition portion 224 may acquire, as the notification printing amount, a printing amount which is reduced from the set printing amount 242 by a specific amount so that a user may cope with a notification with ease, i.e., continue using the ink ribbon for a period of time thereafter without experiencing deteriorated print quality. The specific amount may be a value set by the user, and may be a value set in advance by a device manufacturer.

Next, the cumulative printed amount acquisition portion 225 of the control section 220 acquires the cumulative printed amount 241 from the storage section 240 (step S106). The cumulative printed amount after the ink ribbon cassette 232 was last exchanged is stored in the cumulative printed amount register 241 as described above.

Successively, the determination portion 226 of the control section 220 determines whether or not the cumulative printed amount 241 acquired in step S106 has reached the notification printing amount acquired in step S105 (step S107). If the cumulative printed amount 241 has not reached the notification printing amount (step S107: No), the control section 220 finishes the printing process. If the cumulative printed amount 241 reaches the notification printing amount (step S107: Yes), the flow proceeds to step S108.

If the cumulative printed amount 241 reaches the notification printing amount (step S107: Yes), the output control portion 227 of the control section 220 outputs a notification (hereinafter, referred to as an "exchange notification"), to request exchange of the ink ribbon, to the output section 250 (step S108). The exchange notification may be, for example, a message such as "please exchange the ink ribbon cassette", and may be turning-on or blinking of an LED lamp. If the exchange notification is output, the control section 220 finishes the printing process.

According to the present embodiment, a user may be informed of an appropriate exchange timing of the ink ribbon. As a result, the printing device 200 may minimize deterioration in printing quality due to blurring of ink.

(Second Embodiment)

In the printing system 1 of Embodiment 1, the printing device 200 determines an exchange timing of the ink ribbon, but the terminal device 100 may determine the exchange timing. Hereinafter, a description will be made of the printing system 1 in which the terminal device 100 determines the exchange timing.

Figure 9:
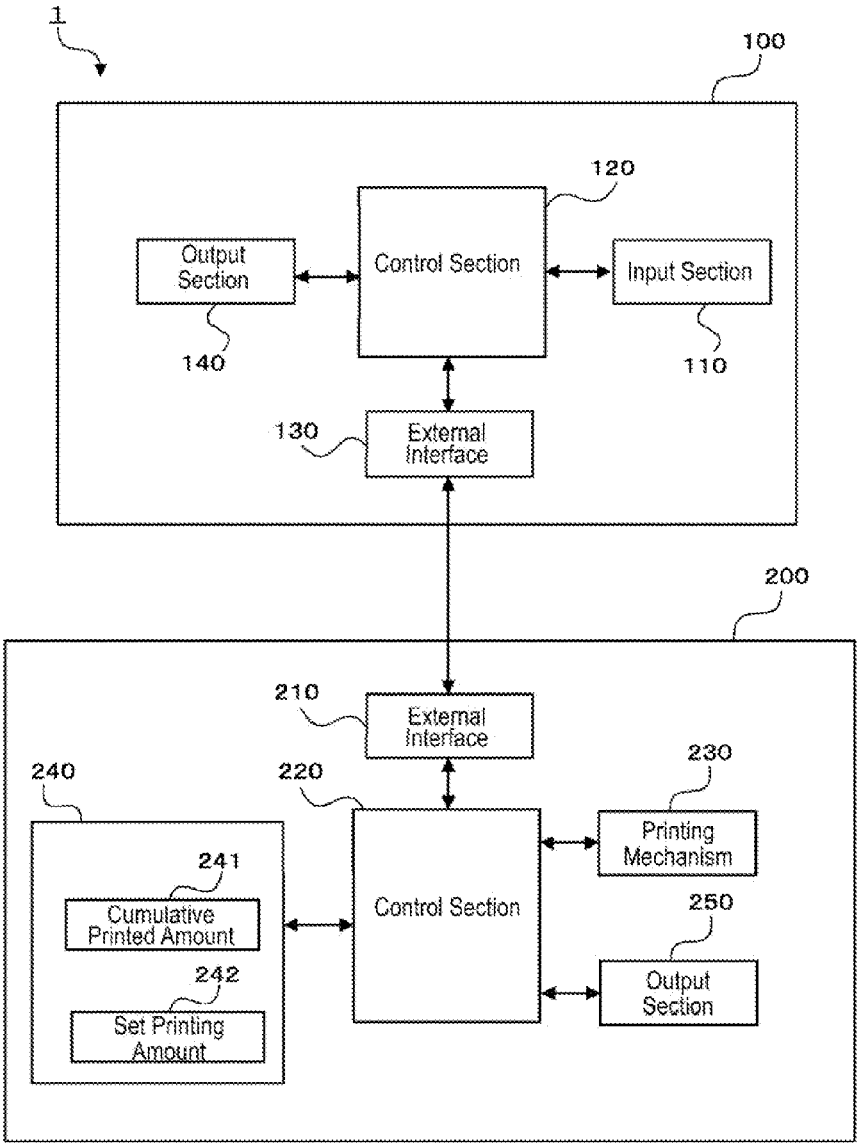
FIG. 9 is a block diagram of a printing system according to a second embodiment.

As illustrated in FIG. 9, a printing system 1 includes a terminal device 100 and a printing device 200. The printing device 200 is installed at a place spaced apart from the terminal device 100. The terminal device 100 and the printing device 200 are connected to each other via a network such as an office LAN, the Internet, or a dedicated line.

The terminal device 100 includes an input and output terminal such as a personal computer. The terminal device 100 includes an input section 110, a control section 120, an external interface 130, and an output section 140.

The input section 110 includes input interfaces such as a keyboard, a mouse, and a touch panel. The input section 110 transmits information which is input from a user, to the control section 120.

Figure 10:
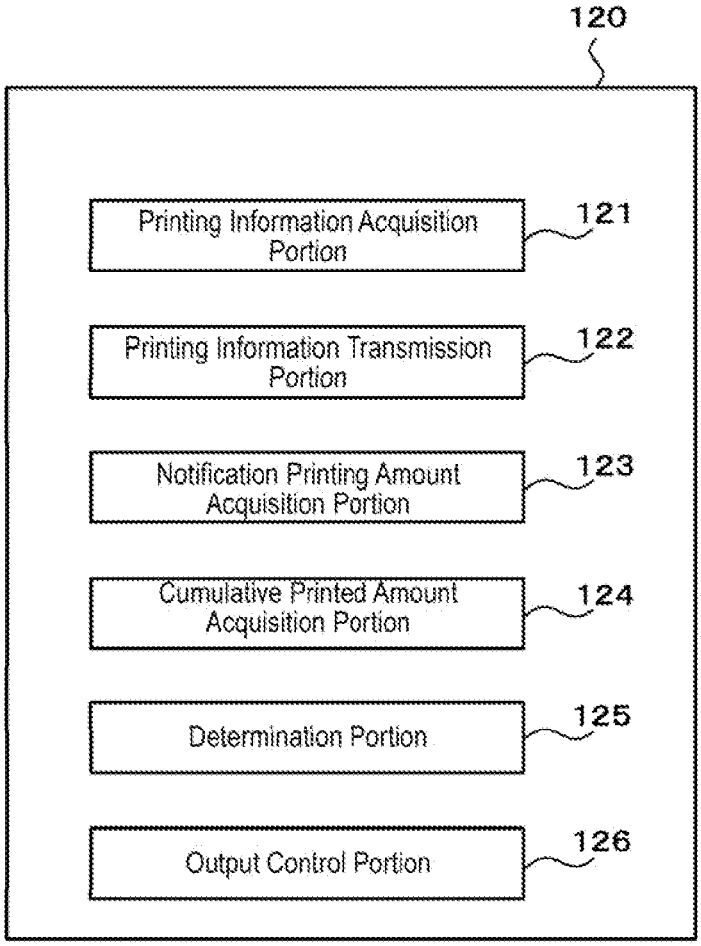
FIG. 10 is a functional block diagram of a control section included in a terminal device.

The control section 120 includes a processing unit such as a processor. The control section 120 is operated according to a program stored in a ROM or a RAM (not illustrated), so as to perform various operations including a "printing process" described later. The control section 120 performs the printing process so as to function as, as illustrated in FIG. 10, a printing information acquisition portion 121, a printing information transmission portion 122, a notification printing amount acquisition portion 123, a cumulative printed amount acquisition portion 124, a determination portion 125, and an output control portion 126. These functions will be described in the "printing process" described later. In addition, the control section 120 may be constituted by a single processor, and may be constituted by a plurality of processors. If the control section 120 includes a plurality of processors, the control section 120 may perform the printing process through cooperation of the plurality of processors.

Referring to FIG. 9 again, the external interface 130 includes an external device connection interface such as a LAN interface or a USB interface. The external interface 130 transmits various information, such as printing information to an external device such as the printing device 200. In addition, the external interface 130 acquires various information from an external device, such as the printing device 200, and transmits the information to the control section 120.

The output section 140 includes output units such as a display, a speaker, and an LED lamp. The output section 140 outputs an image, a sound, and the like under the control of the control section 120.

The printing device 200 is a dot impact printer which prints the printing information transmitted from the terminal device 100 on a printing medium. The printing device 200 includes an external interface 210, a control section 220, a storage section 240, a printing mechanism 230, and an output section 250.

The control section 220 includes a processing unit such as a processor. The control section 220 controls the printing mechanism 230 to print the printing information transmitted from the terminal device 100 on a printing medium, and integrates a printing amount thereof in a cumulative printed amount 241 of the storage section 240. In addition, the control section 220 has a function of transmitting the cumulative printed amount 241, and a set printing amount 242 preserved in the storage section 240, in response to a request from the terminal device 100.

Other configurations of the printing device 200 are the same as those of the printing device 200 of the first embodiment, and thus description thereof will not be repeated.

Next, an operation of the printing system 1 with this configuration will be described.

Figure 11:
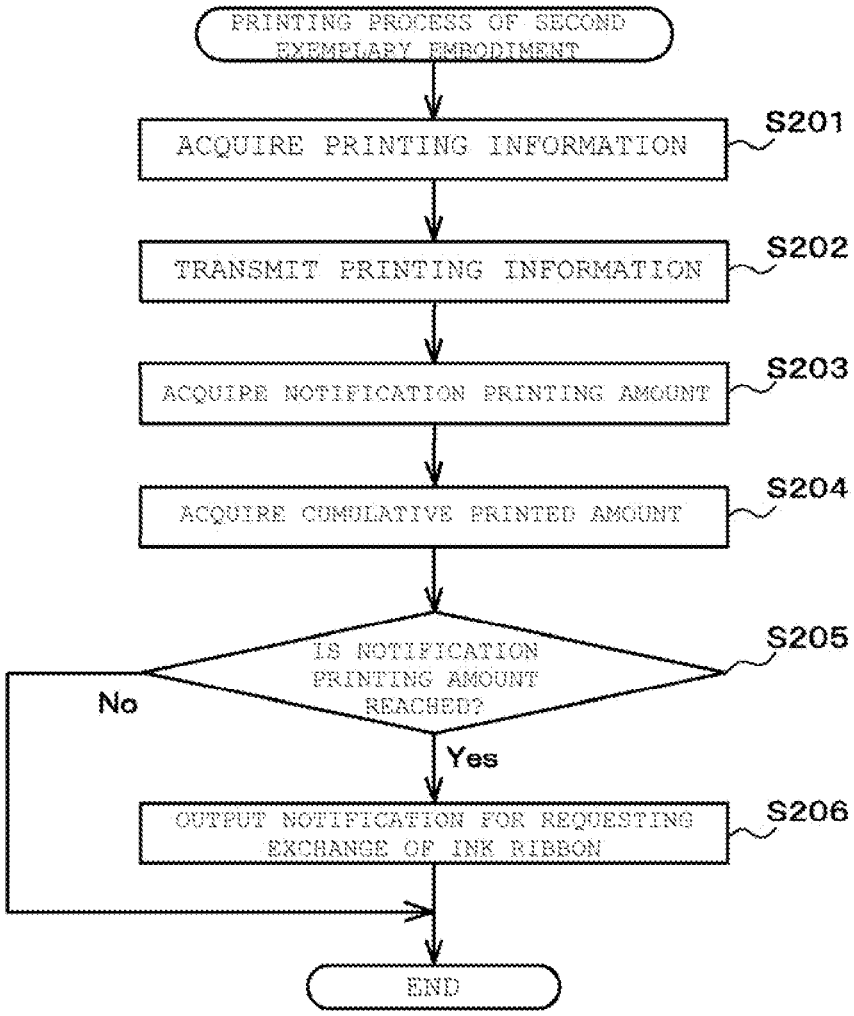
FIG. 11 is a flowchart illustrating a printing process according to the second embodiment.

The control section 120 of the terminal device 100 starts a printing process if printing information is generated based on information input by a user. Hereinafter, with reference to a flowchart of FIG. 11, a bankbook printing process will be described.

The printing information acquisition portion 121 of the control section 120 acquires the printing information which is generated based on an input from the user (step S201). The printing information is generated by the control section 120 or the like based on information acquired from the input section 110. The printing information includes character information such as "AB" and font information such as Draft Font or LQ Font in the same manner as in Embodiment 1.

Next, the printing information transmission portion 122 of the control section 120 transmits the printing information acquired in step S201, to the printing device 200 via the external interface 130 (step S202). The printing device 200 calculates a printing amount of the printing information acquired from the terminal device 100. In addition, the printing device 200 integrates the calculated printing amount in the cumulative printed amount 241 of the storage section 240. Further, the printing device 200 prints the printing information acquired from the terminal device 100 on a printing medium 2.

Next, the notification printing amount acquisition portion 123 of the control section 120 acquires the set printing amount 242 from the printing device 200 via the external interface 130. In addition, a notification printing amount acquisition portion 224 calculates a notification printing amount based on the set printing amount 242 (step S203). At this time, in the same manner as in Embodiment 1, the notification printing amount acquisition portion 224 may acquire the set printing amount 242 as the notification printing amount without change, and may acquire (or create) a printing amount which is calculated based on the set printing amount 242, as the notification printing amount.

Successively, the cumulative printed amount acquisition portion 124 of the control section 120 acquires the cumulative printed amount 241 from the printing device 200 via the external interface 130 (step S204).

Successively, the determination portion 125 of the control section 120 determines whether or not the cumulative printed amount 241 acquired in step S204 has reached the notification printing amount acquired in step S203 (step S205). If the cumulative printed amount 241 has not reached the notification printing amount (step S205: No), the control section 120 finishes the printing process. If the cumulative printed amount 241 reaches the notification printing amount (step S205: Yes), the flow proceeds to step S206.

If the cumulative printed amount 241 reaches the notification printing amount (step S205: Yes), the output control portion 126 of the control section 120 outputs an exchange notification (request to change) of the ink ribbon to the output section 140 (step S206). If the notification is completed, the control section 120 finishes the printing process.

According to the present embodiment, a user may be informed of an appropriate exchange timing of the ink ribbon even if the user operates the printing device 200 from a remote location.

In addition, the above-described each embodiment is only an example, and various modifications and applications are possible.

For example, in the above-described respective embodiments, the printing information is described as character information, but the printing information may be graphic information. Information for designating a resolution of a graphic or a size of a graphic may be appended to the graphic information. In this case, a printing amount accumulation portion 222 may calculates a printing amount of the graphic information by using a printing amount when a single character of Draft Font is printed, as a reference. For example, if a single character of Draft Font is formed by 24 pins×12 slices, the printing amount accumulation portion 222 calculates a printing amount of the graphic information by using an area of a graphic of 24 pins×12 slices as one unit. For example, if a graphic to be printed is formed by 24 pins×24 slices, the printing amount accumulation portion 222 calculates a printing amount of the graphic as 2 (=(24 pins×24 slices)/(24 pins×12 slices)).

In addition, in the above-described respective embodiments, the font information is described as including Draft Font and LQ Font, but the font information is not limited to Draft Font and LQ Font. A font of a resolution other than Draft Font or LQ Font, for example, a font of a resolution such as 24 pins×24 slices, 24 pins×48 slices may be set in the font information.

Figure 12:
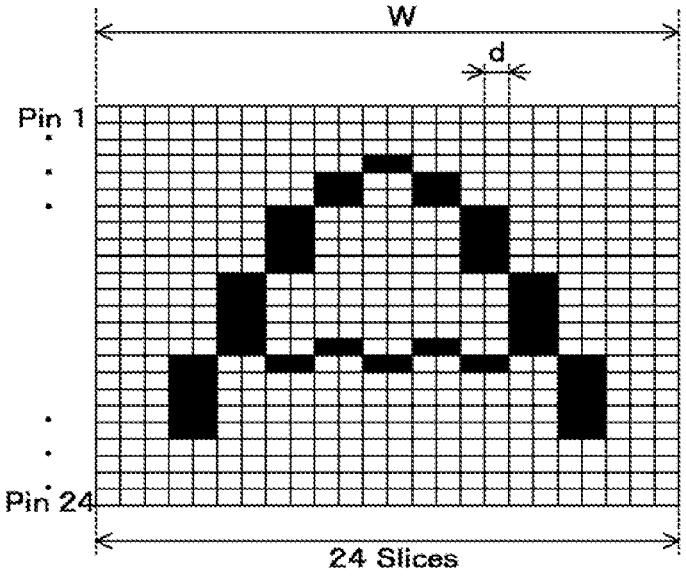
FIG. 12 is a diagram illustrating a character whose width is twice the width of a normal character.
Figure 13:
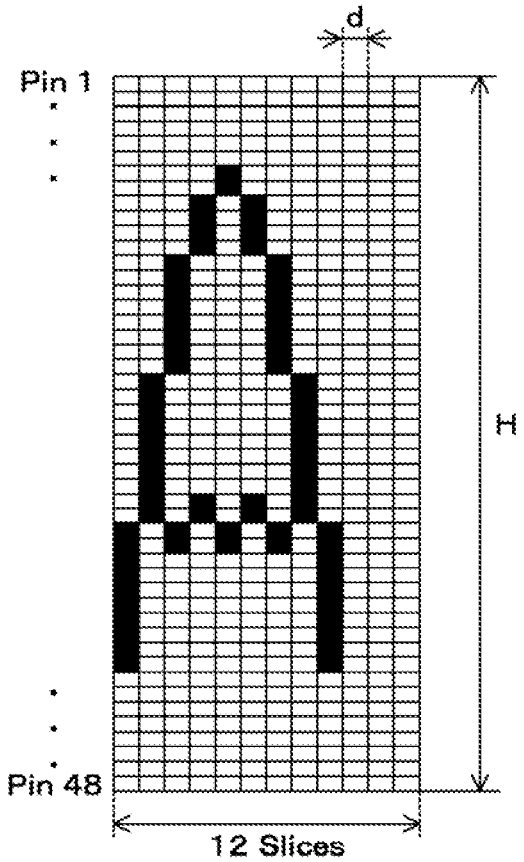
FIG. 13 is a diagram illustrating a character whose height is twice the height of a normal character.

Further, in the above-described respective embodiments, resolution information is described as being set in the font information, but information set in the font information is not limited to the resolution information. Size information indicating a size of a character may be set in the font information. In this case, the "size information" may be information including a character width W or a character height H. For example, if a character width of W=2 and a character height of H=1 are designated, the printing device 200 prints a character whose width is twice the width of a normal character on the printing medium 2, for example, as illustrated in FIG. 12. In addition, if a character width of W=1 and a character height of H=2 are designated, the printing device 200 prints a character whose height is twice the height of a normal character on the printing medium 2, for example, as illustrated in FIG. 13. Further, the "normal character" is a character with a standard size which is set in advance by a device manufacturer or the like.

At this time, the printing amount accumulation portion 222 may calculate a printing amount of the printing information by using a printing amount when a single normal character of Draft Font is printed, as a reference. For example, in a case of FIG. 12 (that is, in a case of a single character of Draft Font with a character width of W=2 and a character height of H=1), the printing amount accumulation portion 222 calculates a printing amount as 2 (=(24 pins×24 slices)/(24 pins×12 slices)). In addition, in a case of FIG. 13 (that is, in a case of a single character of Draft Font with a character width of W=1 and a character height of H=2), the printing amount accumulation portion 222 calculates a printing amount as 2 (=(48 pins×12 slices)/(24 pins×12 slices)). In a case of a single character of Draft Font with a character width of W=2 and a character height of H=2, the printing amount accumulation portion 222 calculates a printing amount as 4 (=(48 pins×24 slices)/(24 pins×12 slices)). Further, in a case of a single character of LQ Font with a character width of W=2 and a character height of H=1, the printing amount accumulation portion 222 calculates a printing amount as 6 (=(24 pins×72 slices)/(24 pins×12 slices)).

In addition, a format of the printing information is not limited to the format illustrated in FIG. 2. Any format may be used so as to be suitable for a specification of a printing device.

In the above-described respective embodiments, the printing head 231*a* is described as including 24 dot pins, but the number of dot pins of the printing head 231*a* is not limited to 24. The number thereof may be 24 or more (for example, 36 or 48), and may be 24 or less (for example, 16 or 8).

In addition, the printing device 200 may be a printing device for household use which performs printing on plain paper or a copying slip, and may be a printing device for business use which performs printing on a bankbook or the like. If the printing device 200 is a printing device for business use, the printing device 200 may be a bankbook printing device mounted in an automated teller machine (ATM). In this case, the printing device 200 may be installed at a place spaced apart from the terminal device 100. In addition, the printing device 200 and the terminal device 100 may be connected to each other via a network such as the Internet or a dedicated line.

In the above-described respective embodiments, the printing device 200 acquires the printing information from the terminal device 100, but the printing device 200 is not necessarily required to acquire the printing information from the terminal device 100. For example, the printing device 200 may include an input section such as an operation panel, and may generate printing information for itself based on an input from the input section.

Figure 14:
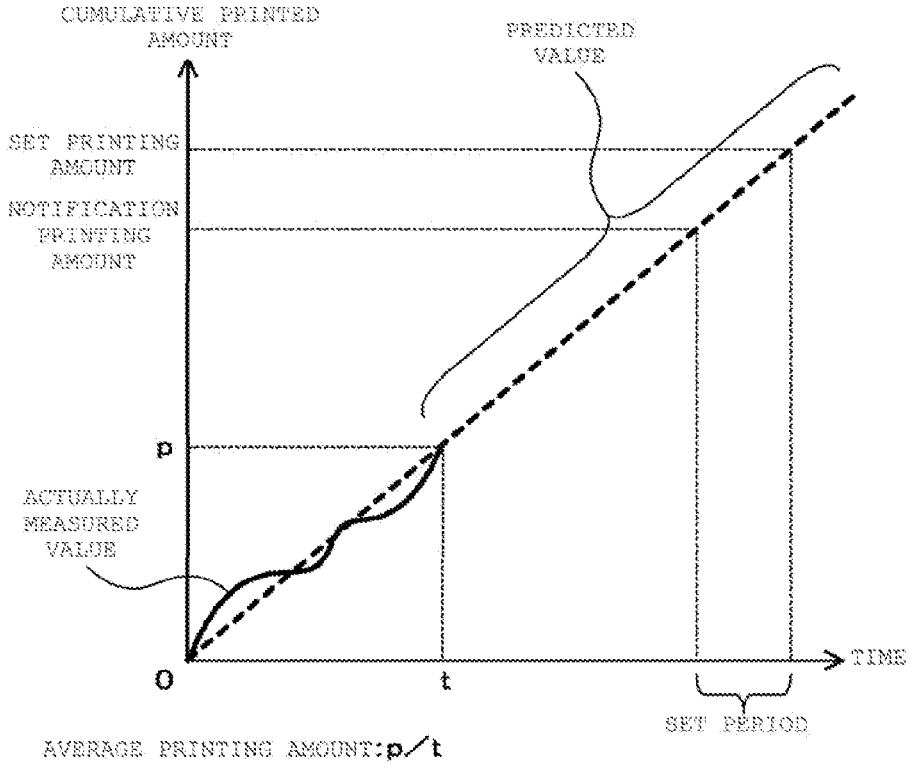
FIG. 14 is a diagram illustrating a relationship between a notification printing amount, a set printing amount, and a set period.

In the respective embodiments, the set printing amount 242 itself, or a printing amount which is reduced from the set printing amount 242 by a specific amount is acquired as a notification printing amount, but a notification printing amount is not limited to such a printing amount. For example, as illustrated in FIG. 14, the notification printing amount acquisition portion 224 or the notification printing amount acquisition portion 123 may acquire, as a notification printing amount, a printing amount in which the cumulative printed amount 241 is estimated to reach the set printing amount 242 within a predetermined period (for example, a set period illustrated in FIG. 14) after the cumulative printed amount 241 reaches a notification printing amount. For example, the notification printing amount acquisition portion 224 or the notification printing amount acquisition portion 123 may acquire, as a notification printing amount, a printing amount in which the cumulative printed amount 241 is estimated to reach the set printing amount 242 within 24 hours after the cumulative printed amount 241 reaches a notification printing amount.

In this case, the notification printing amount acquisition portion 224 or the notification printing amount acquisition portion 123 may calculate a notification printing amount based on a printing amount (hereinafter, referred to as an "average printing amount") of the printing device 200 per unit period based on historical usage of the ink ribbon for printing. For example, if a printing amount of the printing device 200 per hour is 1,000 (1,000 characters of Draft Font with a character width of W=1 and a character height of H=1), and the set printing amount 242 is 1,000,000 (1,000,000 characters of Draft Font with a character width of W=1 and a character height of H=1), the notification printing amount acquisition portion 224 or the notification printing amount acquisition portion 123 may acquire 976,000 (=1,000,000−1,000×24 hours) as a notification printing amount. Since an exchange timing of the ink ribbon 232*b* may be grasped a predetermined period before ink of the ink ribbon 232*b* is exhausted, even if an exchange timing of the ink ribbon 232*b* is limited to after business hours or the like such as the printing device 200 being a bankbook printing device, deterioration in printing quality due to blurring of ink may be minimized. In addition, the unit period is not limited to one hour. For example, the unit period may be one minute, and may be one day.

The notification printing amount acquisition portion 224 or the notification printing amount acquisition portion 123 may have a function of calculating an average printing amount. For example, the printing amount accumulation portion 222 accumulates a printing amount of the printing mechanism 230 in the storage section 240 in correlation with time information, for example, as illustrated in FIG. 15, whenever printing is performed by the printing mechanism 230. In addition, the notification printing amount acquisition portion 224 or the notification printing amount acquisition portion 123 calculates an average printing amount based on the information which is stored in the storage section 240 by the printing amount accumulation portion 222. For example, the notification printing amount acquisition portion 224 or the notification printing amount acquisition portion 123 extracts a record having time information of the same attribute as a current time attribute from among a plurality of records which are accumulated in the storage section 240 by the printing amount accumulation portion 222, and calculates an average printing amount based on a printing amount included in the extracted record. In addition, the "time attribute" is an attribute of time, and is, specifically, a "time slot" such as 13:00 to 14:00, within business hours, or off-business hours, a "day of week" such as Sunday or Monday, a "month" such as January or February, a "season" such as spring or summer, and a "day attribute" such as a holiday, a weekday, a working day, or a nonworking day. Further, the average printing amount may be an average for the whole period since the ink ribbon cassette 232 was last exchanged. Furthermore, the notification printing amount acquisition portion 224 or the notification printing amount acquisition portion 123 calculates a notification printing amount based on the calculated average printing amount and the set printing amount 242.

In the above-described respective embodiments, the output control portion 227 and the output control portion 126 cause the output section 250 or the output section 140 to output an exchange notification or request (a notification for requesting exchange of the ink ribbon), but a notification which the output control portion 227 and the output control portion 126 cause the output section 250 or the output section 140 to output may not be necessarily the exchange notification. For example, a notification which the output control portion 227 and the output control portion 126 cause the output section 250 or the output section 140 to output may be a notification (hereinafter, referred to as an "exchange period notification") indicating an exchange period of the ink ribbon. The exchange period notification may be a message such as "the ink ribbon is required to be exchanged after about 24 hours", and may be the turning-on or blinking of an LED lamp.

In the above-described respective embodiments, a device to which the output control portion 227 and the output control portion 126 send the exchange notification or the exchange period notification is an output device (that is, the output section 250 and the output section 140) mounted in the printing device 200 or the terminal device 100, but a device to which the output control portion 227 and the output control portion 126 send the exchange notification or the exchange period notification may be the printing device 200 or an external output device of the terminal device 100. In this case, an external output device may be a display, a speaker, or an LED lamp in the same manner as in the output section 250 and the output section 140.

In Embodiment 1, the printing device 200 outputs the exchange notification after the printing control portion 223 performs printing, but a timing when the printing device 200 performs the exchange notification or the exchange period notification is not limited to after performing printing. The printing device 200 may determine whether or not a cumulative printed amount reaches a notification printing amount before the printing control portion 223 performs printing, and may perform the exchange notification or the exchange period notification if the cumulative printed amount reaches the notification printing amount. In addition, the printing device 200 may determine whether or not a cumulative printed amount reaches a notification printing amount at any time during printing performed by the printing control portion 223, and may perform the exchange notification or the exchange period notification if the cumulative printed amount reaches the notification printing amount.

In the Embodiment 2, the terminal device 100 outputs the exchange notification after the printing information transmission portion 122 transmits printing information, but a timing when the exchange notification or the exchange period notification is performed is not limited to after transmitting the printing information. The terminal device 100 may determine whether or not a cumulative printed amount reaches a notification printing amount before the printing information transmission portion 122 transmits printing information, and may perform the exchange notification or the exchange period notification if the cumulative printed amount reaches the notification printing amount.

In the above-described respective embodiments, the ink ribbon 232*b* is mounted on the ink ribbon cassette 232 and is detachably installed at the printing mechanism 230 via the ink ribbon cassette 232, but the ink ribbon 232*b* may be directly installed at the printing mechanism 230. In this case, the printing mechanism 230 may be configured such that the ink ribbon 232*b* is attachable thereto and detachable therefrom.

Figure 16:
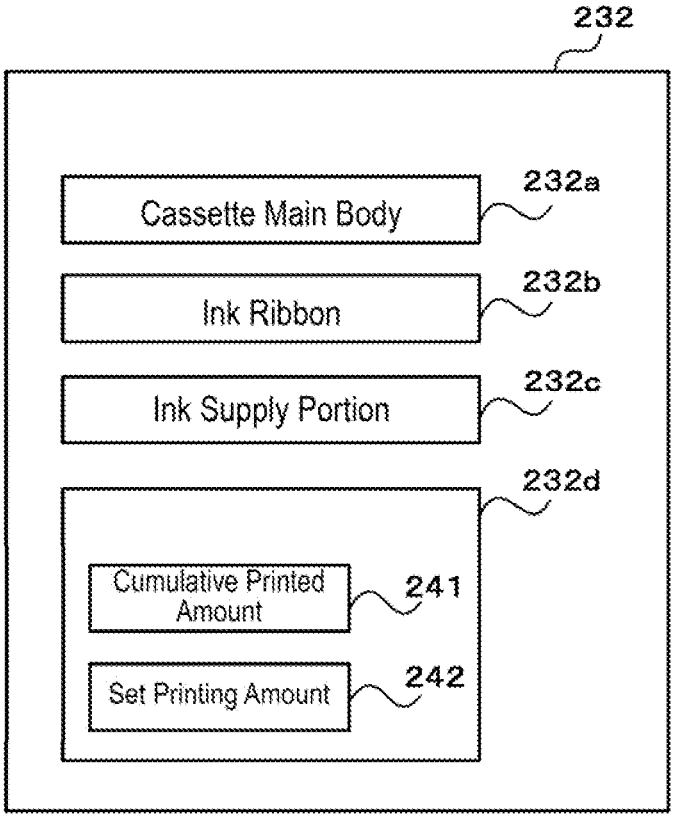
FIG. 16 is a block diagram of an ink ribbon cassette including a storage section which stores a cumulative printed amount and a set printing amount.

In the above-described respective embodiments, the cumulative printed amount 241 and the set printing amount 242 are stored in the storage section 240 of the printing device 200, but a place where the cumulative printed amount 241 and the set printing amount 242 are stored is not limited to the storage section 240. For example, as illustrated in FIG. 16, a storage section 232*d* including a nonvolatile memory such as a flash memory may be provided in the ink ribbon cassette 232, and the cumulative printed amount 241 and the set printing amount 242 may be stored in the storage section 232*d*. In this case, the notification printing amount acquisition portion 224 or the notification printing amount acquisition portion 123 may acquire the set printing amount 242 from the storage section 232*d* of the ink ribbon cassette 232. Similarly, the cumulative printed amount acquisition portion 225 and the cumulative printed amount acquisition portion 124 may acquire the cumulative printed amount 241 from the storage section 232*d* of the ink ribbon cassette 232. In addition, the printing amount accumulation portion 222 may integrate a printing amount in the cumulative printed amount 241 stored in the storage section 232*d* of the ink ribbon cassette 232. If the cumulative printed amount 241 and the set printing amount 242 are directly stored in the ink ribbon cassette 232, mismatch between a state of the ink ribbon cassette 232 indicated by the cumulative printed amount 241 and the set printing amount 242 and an actual state of the ink ribbon cassette 232 may be reduced. Further, information stored in the storage section 232*d* may be both of the cumulative printed amount 241 and the set printing amount 242, and may be either the cumulative printed amount 241 or the set printing amount 242. For example, the cumulative printed amount 241 may be stored in the storage section 232*d* of the ink ribbon cassette 232, and the set printing amount 242 may be stored in the storage section 240 of the printing device 200. Furthermore, a storage section including a nonvolatile memory may be installed in the terminal device 100, and the cumulative printed amount 241 and the set printing amount 242 may be stored in the installed storage section.

In the above-described respective embodiments, the ink ribbon cassette 232 is described as including the ink supply portion 232*c*, but the ink ribbon cassette 232 may not include the ink supply portion 232*c*. In addition, in the above-described embodiments, the ink ribbon 232*b* is formed in a Mobius strip shape, but the ink ribbon 232*b* may not be necessarily formed in a Mobius strip shape as long as the ink ribbon has a loop shape.

The printing device 200 may be a component mounted in an ATM or the like, and may be a single finished product. The printing device 200 may have a function with an ATM, and the printing device 200 may be used as the printer of an ATM.

The printing device 200, the terminal device 100, and the printing system 1 according to the present embodiment may be implemented by a dedicated system, and may be implemented by a normal computer system. For example, a program for performing the above-described operations may be stored on a computer readable recording medium such as an optical disc, a semiconductor memory, a magnetic tape, or a flexible disk and may be distributed, and the program may be installed in a computer so as to perform the above-described processes, thereby configuring the printing device 200 or the like. In addition, the program may be stored in a disk device provided in a server apparatus on a network such as the Internet, and may be downloaded to the computer. Further, the above-described functions may be realized through cooperation of an operating system (OS) and application software. In this case, parts other than the OS may be stored on a medium and be distributed, and parts other than the OS may be stored in the server apparatus and be downloaded to the computer.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printing device comprising:

a printing mechanism that allows a loop-shaped ink ribbon to be detachably installed, and applies an impact to the ink ribbon to transfer ink of the ink ribbon to a printing medium;

a cumulative printed amount acquisition section that acquires a cumulative printed amount of the printing mechanism based upon installation of the ink ribbon on the printing mechanism;

a determination section that determines whether or not the cumulative printed amount acquired by the cumulative printed amount acquisition section has reached a predetermined first printing amount, or whether or not the cumulative printed amount has reached a second printing amount calculated based on the first printing amount; and an output control section that causes an output device to output a predetermined output if the determination section determines that the cumulative printed amount has reached one of the first printing amount and the second printing amount.

2. The device according to claim 1, further comprising:

a printing information acquisition section that acquires printing information concerning printing by the printing mechanism; and a printing amount accumulation section that calculates a printing amount printed by the printing mechanism based on the printing information acquired by the printing information acquisition section, and adds the calculated printing amount to the cumulative printed amount.

3. The device according to claim 2, wherein the printing information includes printed character information, and wherein the printing amount accumulation section calculates the cumulative printed amount based on the number of characters of the character information included in the printing information acquired by the printing information acquisition section.

4. The device according to claim 3, wherein font information designating at least one of a resolution of a character and a size of the character is appended to the character information, and wherein the printed amount accumulation section calculates the cumulative printed amount based on the number of characters of the character information included in the printing information acquired by the printing information acquisition section, and the font information appended to the character information.

5. The device according to claim 2, wherein the printing information includes graphic information, and wherein the cumulative printed amount acquisition section calculates the printing amount based on a resolution of the graphic and a size of the graphic of the graphic information included in the printing information acquired by the printing information acquisition section.

6. The device according to claim 1, wherein the second printing amount is a printing amount at which the cumulative printed amount is estimated to reach the first printing amount within a predetermined period after the cumulative printed amount has reached the second printing amount, wherein the determination section determines whether or not the cumulative printed amount has reached the second printing amount, and wherein the output control section causes the output device to output the predetermined output if the determination section determines that the cumulative printed amount has reached the second printing amount.

7. The device according to claim 6, further comprising:

a printing amount accumulation section that accumulates a printed amount printed by the printing mechanism in correlation with time information; and a notification printing amount acquisition section that calculates an average printed amount of the printing mechanism based on information on the printed amount accumulated in correlation with the time information in the printed amount accumulation section, and calculates the second printing amount based on the average printing amount and the first printing amount.

8. The device according to claim 1, wherein the ink ribbon is stored in an ink ribbon cassette, wherein the printing mechanism allows the ink ribbon cassette in which the ink ribbon is stored to be attachable thereto and detachable therefrom, wherein the ink ribbon cassette includes a storage section that stores the cumulative printed amount, and wherein the cumulative printed amount acquisition section acquires the cumulative printed amount from the storage section of the ink ribbon cassette.

9. A notification method comprising:

acquiring a cumulative printed amount of a printing mechanism since an ink ribbon installed on the printing mechanism was last exchanged, the printing mechanism allowing the loop-shaped ink ribbon to be detachably installed thereto and applying an impact to the ink ribbon to transfer ink of the ink ribbon to a printing medium;

determining whether or not the cumulative printed amount acquired has reached a predetermined first printing amount, or a second printing amount calculated based on the first printing amount; and causing an output device to output a predetermined output if it is determined that the cumulative printed amount reaches the first printing amount or the second printing amount.

10. The notification method of claim 9, wherein the cumulative printed amount is determined based upon a standard print amount per character printed using the ink ribbon.

11. The notification method of claim 10, wherein the standard print amount is based on the printing of a standard character or an equivalent number of standard characters, based at least in part on the resolution or size of the character.

12. The notification method of claim 11, wherein the first printing amount is based on the quantity of standard characters which may be printed from a new ink ribbon without experiencing unacceptable deterioration of the quality of the image printed therefrom.

13. The notification method of claim 12, wherein the cumulative printed amount is updated after every character is printed.

14. The notification method of claim 13, further comprising:

comparing a characteristic of the printed character to a standard character, and calculating a number of printed standard characters represented by the printed character; and updating the cumulative printed amount by the calculated number of standard characters representative of the print amount of the printed character.

15. The notification method of claim 13, wherein the second printing amount is an amount less than the total amount of printing that can be undertaken with the ink ribbon before experiencing deterioration in print quality, and the first printing amount is the total amount of printing that can be undertaken with the ink ribbon before experiencing deterioration in print quality.

16. The notification method of claim 9, further comprising:

comparing the time of use of the ink ribbon to the cumulative printed amount;

comparing the cumulative printed amount to at least one of the first printing amount and second printing amount;

calculating a time when one of the first or second printing amount will be reached based on past usage of the ink ribbon; and providing a notification to change the ink ribbon at a set time in the future.

17. An ink ribbon cassette configured to be attachable to and detachable from a printing device, the cassette comprising:

a loop-shaped ink ribbon; and a storage section that stores a cumulative printed amount, wherein the printing device includes a printing mechanism that allows the ink ribbon cassette storing the loop-shaped ink ribbon to be detachably installed thereto, and applies an impact to the ink ribbon to transfer ink of the ink ribbon to a printing medium;

a cumulative printed amount acquisition section that acquires a cumulative amount of printing of the printing mechanism since the ink ribbon of the ink ribbon cassette was installed on the printing mechanism, from the storage section of the ink ribbon cassette;

a determination section that determines whether or not the cumulative printed amount acquired by the cumulative printed amount acquisition section reaches a predetermined first printing amount, or whether or not the cumulative printed amount reaches a second printing amount calculated based on the first printing amount; and an output control section that causes an output device to perform a predetermined output if the determination section determines that the cumulative printed amount reaches the first printing amount or the second printing amount.

18. The ink ribbon cassette of claim 17, wherein the first printing amount is based on a number of characters which can be printed with the ink ribbon before unacceptable deterioration in print quality occurs.

19. The ink ribbon cassette of claim 17, wherein the number of characters which can be printed with the ink ribbon before unacceptable deterioration in print quality occurs is based upon a standard character.

20. The ink ribbon cassette of claim 17, wherein the ink ribbon has a Mobius strip shape.

* * * * *